United States Patent [19]

Klaiber

[11] 4,266,746

[45] May 12, 1981

[54] PAINT BRUSH, PAD AND ROLLER HOLDER AND CAN CARRIER

[76] Inventor: William C. Klaiber, 601 York Rd., Fayetteville, N.C. 28303

[21] Appl. No.: 45,930

[22] Filed: Jun. 6, 1979

[51] Int. Cl.[3] ..... B44D 3/12; B65D 25/00

[52] U.S. Cl. ..... 248/113; 15/257 R; 220/90; 220/95; 248/210

[58] Field of Search ..... 224/45 P, 45 R, 45 Q, 224/45 C; 15/257 R, 264; 206/1.7, 361, 362; 401/121, 123; 248/110, 111, 112, 113; 220/90, 85 R, 95

[56] References Cited

U.S. PATENT DOCUMENTS

| | | | |
|---|---|---|---|
| 731,289 | 6/1903 | Domagola | 248/10 X |
| 1,865,283 | 6/1932 | Sohnle | 248/113 X |
| 2,540,860 | 2/1951 | Blomquist | 15/257 R X |
| 2,542,737 | 2/1951 | Vogel | 248/111 X |
| 2,788,153 | 4/1957 | Broadbelt | 248/110 X |
| 2,948,413 | 4/1960 | Gorrell et al. | 248/10 X |
| 3,462,789 | 8/1969 | Seal | 248/113 X |

*Primary Examiner*—Robert J. Spar
*Assistant Examiner*—Jerold M. Forsberg
*Attorney, Agent, or Firm*—Harvey B. Jacobson

[57] ABSTRACT

A wide elongated upstanding rearwardly inclined support including a lower elongated, transverse shelf projecting outwardly from and extending transversely of the front side of the support toward which the lower end of the support is inclined. The shelf includes longitudinally spaced opposite end portions defining a drainage slot therebetween and the shelf opposite end portions are inclined with the adjacent ends thereof slightly downwardly inclined and project upwardly and outwardly from front side of the support. Further, structure is carried by the lower end of the support below the shelf opposite end portions and to be used in mounting the support from the upper rim portions of a paint can, paint box, or roller tray.

4 Claims, 7 Drawing Figures

PAINT BRUSH, PAD AND ROLLER HOLDER AND CAN CARRIER

BACKGROUND OF THE INVENTION

Field of the Invention

This invention relates to a combined paint brush, paint roller and paint pad holder which may be used on all standard one gallon paint cans and all standard paint trays and all standard paint boxes and further includes structure whereby it may be utilized as a carrier for and be supported from a one gallon can. The holder may be employed to hold a paint brush, paint roller or a paint pad in position whereby excess paint dripping from the brush, roller or pad will be returned to the interior of the associated can, tray or box. Further, the holder is designed to support a paint brush and roller or a trim brush and paint pad simultaneously.

Various forms of paint roller, brush and pad holders have been heretofore provided for supporting rollers, brushes and paint pads during short periods of nonuse. However, most of these holders have not been constructed in a manner wherein they may be utilized for holding either a paint roller, brush or a pad and also in a manner in which they may be readily supported from a paint tray, a paint can or a paint box. Accordingly, a need exists for an improved holder which may be utilized not only for supporting a paint roller from a paint tray and a paint brush when supported from a paint can, but also for supporting a paint pad and trim brush when supported from a paint box.

SUMMARY OF THE INVENTION

Accordingly, the main object of this invention is to provide a paint brush, pad and roller holder which may be utilized to support either a paint brush, pad or a roller from a paint can, box or roller tray during short periods of nonuse of the brush, roller and pad.

Another object of this invention is to provide a holder which will be effective in catching and returning excess paint which may drain from the supported brush, pad or roller and return the excess paint to the associated can, box or tray.

Still another object of the invention is to provide a holder for a paint brush and mounting on a paint can and which includes an accessory portion defining a handle for the associated paint can.

Another object of this invention is to provide a holder which may be readily and quickly attached and subsequently removed from an associated paint can or holder.

A final object of this invention to be specifically enumerated herein is to provide a brush, roller and paint pad holder in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
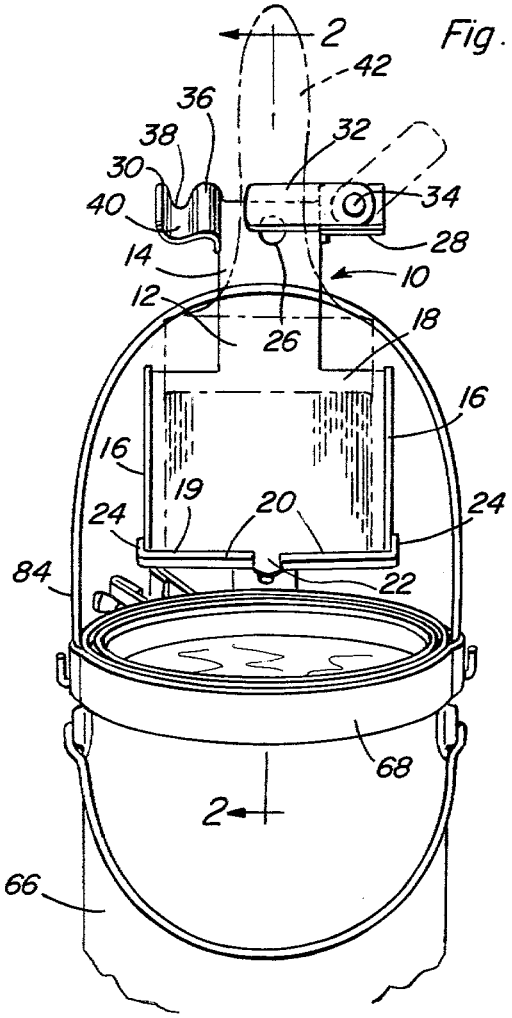
FIG. 1 is a fragmentary perspective view of a one gallon paint can with the holder of the instant invention mounted on the can and defining a support handle for the can, an associated paint brush being illustrated supported from the holder in phantom lines.
Figure 3:
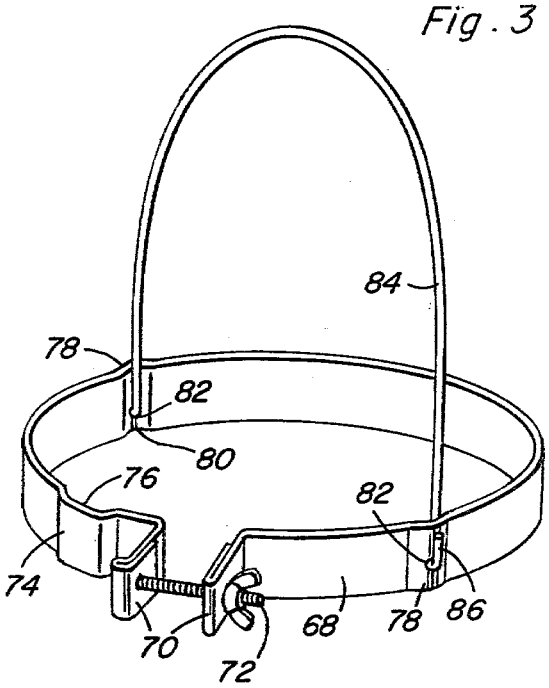
FIG. 3 is an enlarged perspective view of the holder attaching and handle defining component of that form of the invention illustrated in FIG. 1.

Referring now more specifically to the drawings, the numeral 10 generally designates the holder of the instant invention. The holder 10 includes a wide elongated upstanding support 12 defined by a sheet metal panel section including a transversely reduced upper end portion 14 and opposite side flanges 16 which project outwardly from one side of the support 12 and extend along the vertical extent of the lower end portion 18 thereof. Also, it will be noted from FIG. 2 of the drawings, that the support 12 is inclined with the upwardly and outwardly facing front side thereof comprising the side from which the flanges 16 project. Further, the lower marginal edge of the support 12 includes a horizontally outwardly projecting and transversely extending elongated shelf 19 comprising longitudinally spaced opposite end portions 20 defining a drain slot 22 between the adjacent ends thereof. The remote ends of the end portions 20 include upturned end flanges 24 which overlap the outer sides of the lower ends of the flanges 16 and the end portions 20 are slightly downwardly inclined toward the slot 22.

The upper end portion 14 has a central opening 26 formed therethrough and opposite side tab portions 28 and 30. The tab portion 28 is offset from the main portion of the sheet metal panel section toward the front side thereof and has a latch flange 32 pivotally secured thereto as at 34. The tab portion 28 initially extends outwardly from the front side of the sheet metal panel section and then is bent outwardly and rearwardly as at 36 and then outwardly and inwardly as at 38 to define a roller handle shaft receiving trough 40, the latch flange 32 being swingable from the phantom line position of FIG. 1 to the solid line position of FIG. 1 in order to retain the handle 42 of a brush supported from the holder 10 in position thereon.

Figure 6:
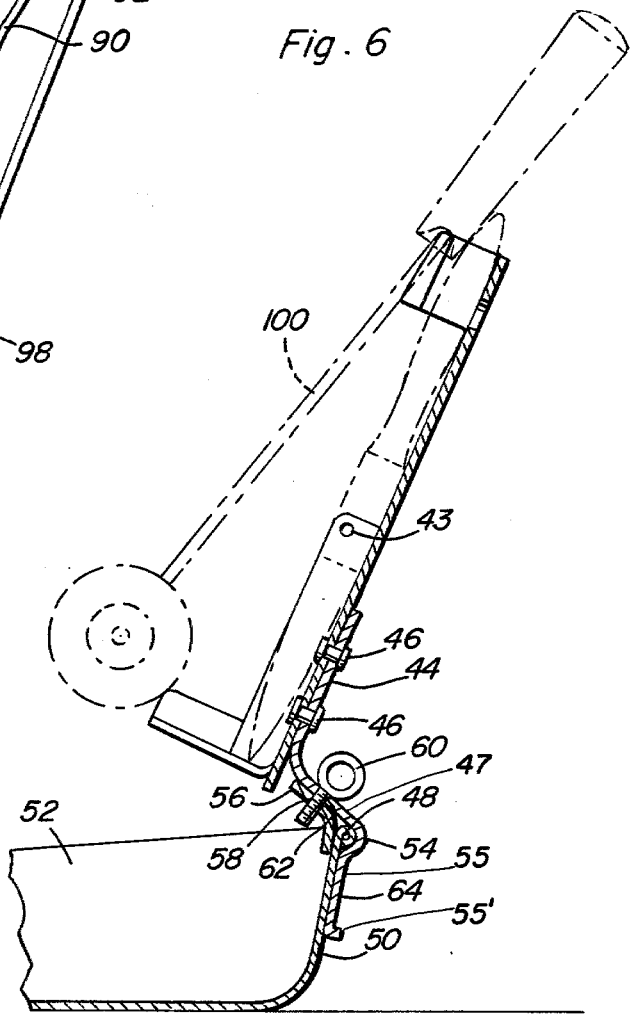
FIG. 6 is an enlarged fragmentary vertical sectional view taken substantially upon the plane indicated by the section line 6—6 of FIG. 5.
Figure 5:
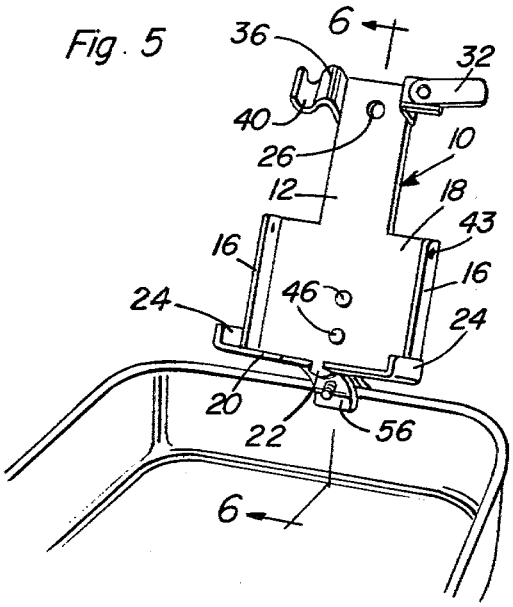
FIG. 5 is a fragmentary perspective view of the holder supported from the deep end of a paint roller tray.
Figure 7:
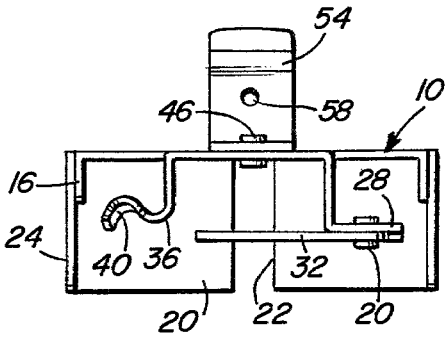
FIG. 7 is a top plan view of the holder.

The upper ends of the flanges 16 include transverse bores 43 formed therethrough whereby suitable attachments may be supported from the holder 10 and the lower central portion of the sheet metal panel section has a depending mounting bracket 44 secured thereto as by rivets 46. The bracket 44 includes a rearwardly and downwardly inclined portion 47 and the lower end of the mounting bracket is contoured to fit over the upper edge 48 of one of the upstanding peripheral walls 50 of a paint tray 52 and the portion 47 terminates downwardly in a forwardly bowed portion 54 for snugly embracing the head of the pan 52 which defines the upper edge portion 48. The forwardly bowed portion 54 terminates forwardly in a depending portion 55 terminating downwardly in a rearwardly directed flange 55'. An angulated latch flange 56 provided with a threaded bore 58 is provided and is secured to the mounting bracket 44 by a threaded eyebolt 60 passed through a bore 62 in the mounting bracket 44 aligned with the bore 58. The latch flange 56 overlies the inner surface of the upper marginal edge portion of the wall 50 over the outer surfaces of which the portions 54 and 55 of the mounting bracket 44 extend, the bracket 44 defining a shallow outwardly opening channel 64 between portion 54 and flange 55' for a purpose to be hereinafter more fully set forth. From FIGS. 5 and 6 of the drawings it may be seen that the holder 10 may be readily supported from the end wall of the tray 52 at the deep end thereof.

Figure 2:
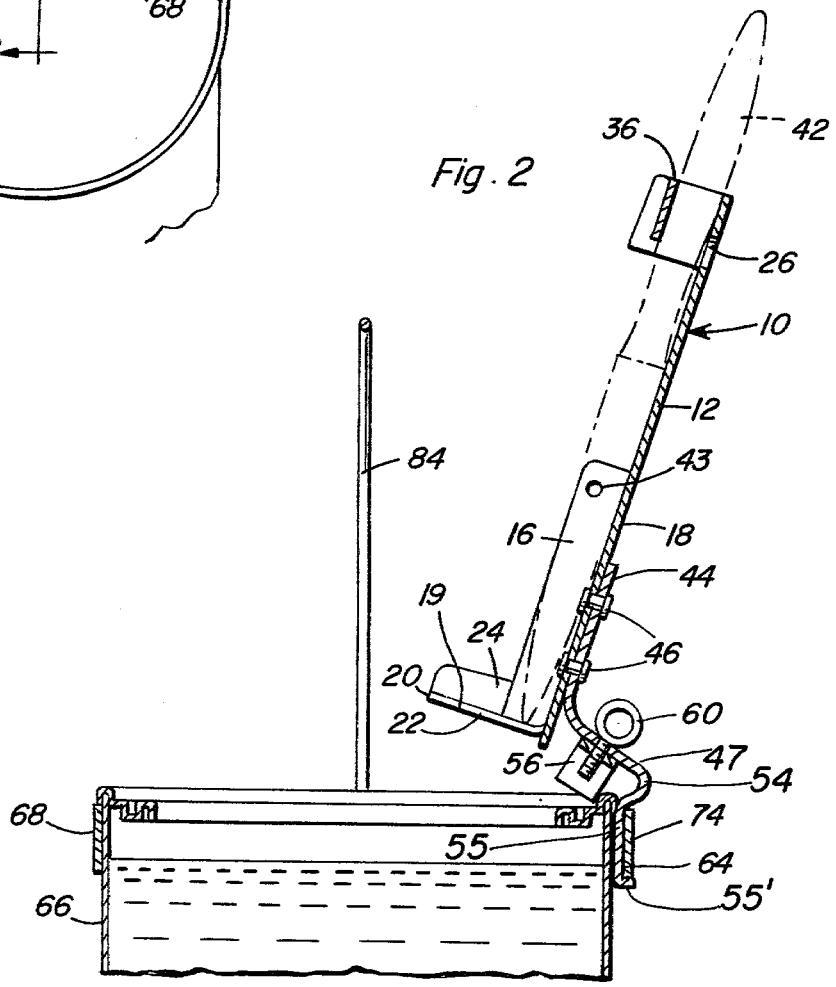
FIG. 2 is an enlarged fragmentary vertical sectional view taken substantially upon the plane indicated by the section line 2—2 of FIG. 1.

However, if the holder 10 is to be utilized in conjunction with a one gallon paint can, such as that indicated by the reference numeral 66 in FIGS. 1 and 2, a clamp-type band 68 is provided including closely opposing and outwardly directed opposite end portions 70 having a clamp fastener 72 secured therebetween. The band 68 further includes a portion 74 thereof defining an inwardly opening upstanding channel 76 and diametric opposite portions of the band 68 include additional contoured portions 78 which define upstanding diametrically opposite opposing channels 80. The portions 78 are provided with small diameter radial bores 82 and the lower ends of a vertically elongated bail-type handle 84 are received in the channels 80 and include terminal ends 86 extending outwardly through the bores 82 and bent upwardly over the outer surfaces of the portions 78. The band 68 is clamped about the upper rim portion of the can 66 in the manner illustrated in FIGS. 1 and 2 of the drawings and the portion of the mounting bracket 44 defining the channels 64 is embraced in the channel 76 defined by the portion 74 of the band 68. In this manner, the lower end of the mounting bracket 44 is securely fastened to the upper rim portion of the can 66.

Figure 4:
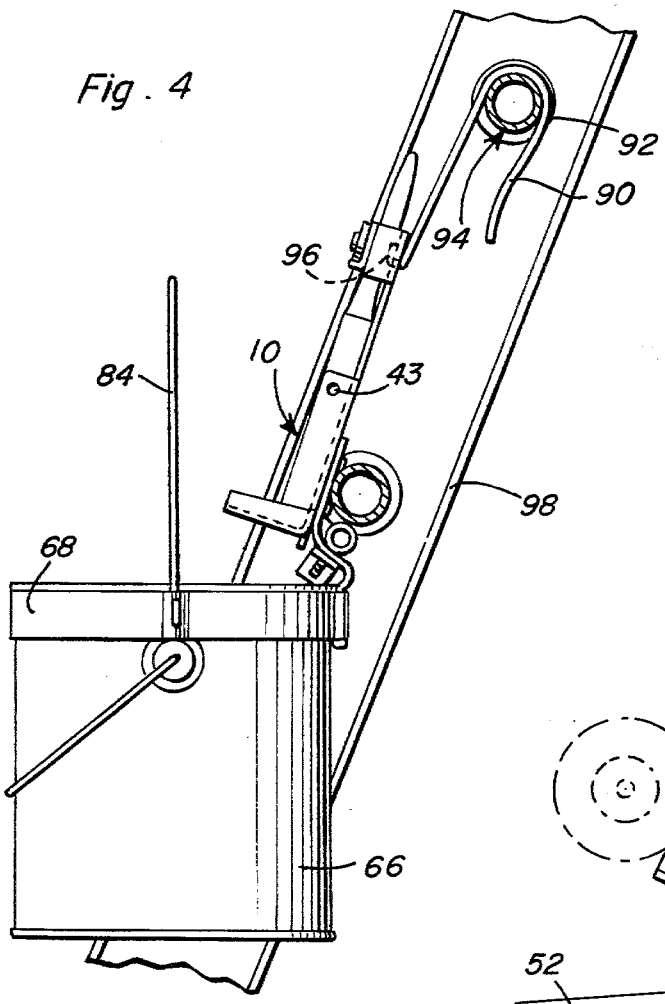
FIG. 4 is a fragmentary vertical section view illustrating the manner in which the holder may be utilized to support a paint can from the ladder.

Also, from FIG. 4 of the drawings, it may be seen that any suitable form of hook 90 may have one hook end 92 engaged with a ladder rung 94 and a second hooked end 96 thereof engage with the opening 26 formed in the upper end portion 14 of the sheet metal panel section 12. By this manner, the holder 10 and bucket or can 66 may be supported effectively from the ladder 98 of which the rung 94 comprises a part. Also, by support of the holder 10 from the rung 94, the can 66 is adequately supported from the ladder 98.

When it is desired, a paint brush may be supported from the holder 10 in the manner illustrated in phantom lines in FIG. 1 and solid lines in FIG. 4. In addition, a paint roller such as that indicated by the reference numeral 100 may be supported from the holder 10 in the manner illustrated in FIG. 6. The shelf end portions 20 collect excess paint which may flow from the brush supported from the holder 10 and the collected paint is directed, by gravity, to the slot 22. Thereafter, the collected paint may fall through the slot 22 and back into the can 66.

It is to be noted that the holder 10 may be supported from any upstanding wall of a roller tray, but that it is preferable for the holder 10 to be supported from the end wall of the associated tray at the deep end thereof. Further, any suitable form of wire, such as a coat hanger wire, may be utilized to form the double hook 90 and it will be noted that the holder 10 supports an associated brush closely adjacent one side of the paint can from which the holder 10 is supported. Thus, access to the interior of the can with the paint brush is not limited. Also, the vertically elongated bail-type handle 84 eliminates the necessity of a painter having to bend over in order to pick up an associated can from a floor surface while transporting the can to another painting area.

It is further pointed out that the holder 10 may be used to alternately support the roller 100 or a paint brush therefrom, particularly when the holder 10 is to be supported from a paint tray. When the roller is being utilized, the paint brush may be supported from the holder and when it is desired to apply the same paint to a trim area, the roller may be supported from the holder 10 while the paint brush is in use. Also, the outer free edges of the shelf end portions 20 may be utilized to wipe excess paint from a trim brush, and it is to be noted that the holder 10 does not require any alterations to the associated paint can or tray. Further, when the holder 10 is to be utilized on a paint can rather than a paint tray, the eyebolt 60 may be loosened and the latch flange 56 may be rotated 90° and the eyebolt 60 retightened in order that the locking flange 56 may be conveniently supported in an inoperative position during utilization of the holder 10 on a paint can.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A wide elongated upstanding inclined support including front and rear sides and a lower elongated, transverse shelf projecting outwardly from and extending transversely from the front side of the support toward which the lower end of the support is inclined, said shelf including longitudinally spaced opposite end portions defining a drainage slot therebetween, said shelf opposite end portions being upwardly and outwardly inclined from said support, and mounting means carried by the lower end of said support below the shelf adapting the support for alternately mounting said support on the upper rim portion of a paint can, roller tray or paint box peripheral wall, the upper portion of said support defining a transversely narrowed upper end portion including opposite side tab portions projecting outwardly from the front side of said support, said tab portions being spaced apart a distance for receiving the upper portion of a paint brush handle therebetween, one of said tab portions including a pivoted latching lever supported therefrom and swingable in a plane generally paralleling said inclined support, said latching lever being swingable to a position bridging the spacing between said tab portions and for releasably retaining said paint brush handle between said tab portions, the other of said tab portions being reversely bent to define a channel extending longitudinally of the support and opening laterally outwardly of the front side of said support, said channel being adapted to receive the handle portion of a paint roller therein having the roller portion thereof supported from the forward portion of said shelf, said mounting means including a rearwardly and downwardly inclined mounting bracket portion carried by the lower end of said support, said mounting bracket portion terminating rearwardly in a forwardly bowed portion in turn terminating forwardly in a downwardly directed portion including a lower rearwardly directed flange spaced below said bowed portion, said downwardly directed portion defining a transverse rearwardly opening channel between said bowed portion and said rearwardly directed flange for receiving therein a clamp band clamped about the upper end of a paint can, said mounting means also including an elongated angulated latch flange pivotally supported at one end to the forward side of said rearwardly and downwardly inclined portion above said forwardly bowed portion and swingable into and out of position with the other end portion of said latch flange closely paralleling the front side of said downwardly directed portion and with said latch flange bridging across said forwardly bowed portion for clampingly engaging the upper reinforcing bead of one wall of a paint tray.

2. The combination of claim 1 wherein said shelf end portions are inclined downwardly toward their adjacent ends.

3. The combination of claim 2 wherein the lower portion of said support, above said shelf, includes upstanding opposite side flanges projecting outwardly from said support in the same direction in which said shelf projects.

4. The combination of claim 3 wherein the remote ends of said shelf opposite end portions include upstanding transverse end flanges overlapping the lower ends of said opposite side flanges.

* * * * *